US007659705B2

(12) United States Patent
Hung

(10) Patent No.: US 7,659,705 B2
(45) Date of Patent: Feb. 9, 2010

(54) LOW-POWER START-UP CIRCUIT FOR BANDGAP REFERENCE VOLTAGE GENERATOR

(75) Inventor: Kenneth Wai Ming Hung, Hong Kong (HK)

(73) Assignee: Smartech Worldwide Limited, Hong Kong (CN)

( * ) Notice: Subject to any disclaimer, the term of this patent is extended or adjusted under 35 U.S.C. 154(b) by 452 days.

(21) Appl. No.: 11/687,612

(22) Filed: Mar. 16, 2007

(65) Prior Publication Data

US 2008/0231248 A1 Sep. 25, 2008

(51) Int. Cl.
*G05F 3/30* (2006.01)

(52) U.S. Cl. ..... 323/313; 323/316; 323/901

(58) Field of Classification Search ..... 323/313, 323/901, 316, 314, 315, 317; 327/539
See application file for complete search history.

(56) References Cited

U.S. PATENT DOCUMENTS 4,857,823 A 8/1989 Bitting
5,087,830 A 2/1992 Cave
5,629,611 A * 5/1997 McIntyre ..... 323/313
5,751,182 A 5/1998 Thiel
5,969,549 A 10/1999 Kim
6,060,918 A 5/2000 Tsuchida
6,084,388 A 7/2000 Toosky
6,201,435 B1 3/2001 Chou
6,222,399 B1 4/2001 Imbornone
6,294,943 B1 * 9/2001 Wall et al. ..... 327/328
6,356,064 B1 3/2002 Tonda
6,724,176 B1 * 4/2004 Wong et al. ..... 323/316

* cited by examiner

*Primary Examiner*—Harry Behm
(74) *Attorney, Agent, or Firm*—Xin Wen

(57) ABSTRACT

A bandgap voltage reference circuit includes a bandgap voltage generation circuit that can produce a bandgap reference voltage in response to an activation voltage signal, a start-up circuit that can produce the activation voltage signal in response to one-shot voltage pulse and an one-shot pulse generator circuit configured to produce the one-shot voltage pulse. The start-up circuit can be automatically shut off after the one-shot voltage pulse.

11 Claims, 6 Drawing Sheets

LOW-POWER START-UP CIRCUIT FOR BANDGAP REFERENCE VOLTAGE GENERATOR

BACKGROUND

The present disclosure relates to an electronic circuit, more particularly, to a fast start-up circuit for a bandgap reference voltage generator.

A bandgap reference voltage generator can provide a voltage reference that is independent of the voltage supply and temperature. A bandgap reference voltage generator is commonly used in mixed-signal designs that include analog blocks. A bandgap reference voltage generator is similar to a voltage regulator and a current reference. A bandgap reference voltage generator typically includes two operation conditions for the bandgap; a power-down point and a start-up point. The power-down point can provide bias to the gates of PMOS transistors at the voltage of the high voltage supply (VDD) to prevent current flowing through the bandgap reference voltage circuit. The bandgap output voltage is kept near the bandgap voltage of the semiconductor substrate. The bandgap voltage for Silicon-based substrate is about 1.25V. At the start-up point, the PMOS transistors are biased in saturation region. A DC current flows through the bandgap reference voltage circuit. The bandgap output voltage is around 1.25V, which is the bandgap voltage of silicon.

Some conventional bandgap reference voltage generators can provide proper start-up operations. However, the conventional bandgap reference voltage generators usually include several drawbacks. Some conventional bandgap reference voltage generators cannot provide a fast start-up. They take quite a long time to start from a power-down state. Some conventional bandgap reference voltage generators draw static DC current after the bandgap voltage reference circuit becomes stable.

Referring to FIG. 1, a conventional bandgap voltage reference circuit 100 includes an operational amplifier (op-amp) 110, bipolar transistors 114 and 115 that are connected as diodes, resistors 111-113, and a biased PMOS transistor 108. The resistors 111-113 respectively have resistance Ra, Rb, and Rc. VBG is the bandgap voltage output.

A relation between current I and voltage $V_f$ in a diode can be expressed as $$I = I_S \times (e^{q(V_f/kT)-1}) \tag{1}$$

$$\cong I_S \times (e^{q(V_f/kT)})$$

$$\text{for } V_f \gg kT/q$$

$$V_f = V_T \times \ln(I/I_S) \tag{2}$$

where k is Boltzmann constant ($1.38\times10^{-23}$ J/K), $I_S$ is a constant describing the transfer characteristic of the transistor in the forward-active region, q is the electronic charge ($1.6\times10^{-19}$ C), and the thermal voltage $V_T$ is defined by $V_T$=kT/q. Two inputs for the operational amplifier 110 are connected to nodes 150 and 151. The operational amplifier 110 is designed to keep the voltages at the nodes 150 and 151 the same. Defining Vf1 and Vf2 respectively as the diode voltages of the bipolar transistors 114, 115 that are connected as diodes, the difference between Vf1 and Vf2 is $$dVf = Vf1 - Vf2 = V_T \ln(N\,Rb/Rc) \tag{3}$$

where N is the geometric ratio of bipolar transistor 115 to 114. N is normally equal to 4. The bandgap output voltage VBG then becomes $$VBG = Vf1 + (Rb/Rc)dVf \tag{4}$$

$$= Vf1 + (Rb/Rc)V_T \ln(N\,Rb/Rc)$$

Vf1 has a negative temperature coefficient of −2 mV/° C., whereas $V_T$ has a positive temperature coefficient of 0.086 mV/° C. VBG is determined by the resistance ratio, being little influenced by the absolute value of the resistance. By varying N, Rb, Rc, the bandgap voltage VBG can be tuned to be around the bandgap energy of the semiconductor substrate. For a silicon-based integrated circuit, VBG can thus be controlled to be about 1.25V. Further, the temperature dependence of VBG can be negligibly small. In addition, VBG does not depend on supply voltage as long as the power supply is not lower than VBG.

A drawback associated with the bandgap voltage reference circuit 100 is that the bandgap voltage reference circuit 100 cannot properly start up a circuit during a power down. During power up from power down state, the gate bias of PMOS transistor 108 is undefined and may be biased at VDD due to the coupling effect from VDD through its gate to source capacitance. Also, as the gate bias of PMOS transistor 108 is undefined, the start-up time is not controllable, which can lead to an unpredictable start-up operation.

FIG. 2 shows another conventional bandgap voltage reference circuit 200 having a start-up circuit 220. The start-up circuit 220 includes a PMOS transistor 206, a self-biased inverter (with its input connected to its output) consisting of a PMOS transistor 202 and an NMOS transistor 203, and an NMOS transistor 204. The gate of the PMOS transistor 206 is connected with the gates of the PMOS transistor 202 and an NMOS transistor 203 at a node 205. Other components of the bandgap voltage reference circuit 200 are similar to bandgap voltage reference circuit 100.

During power up, the node 205 is biased at (VDD−VTP+VTN)/2, where VTP is the PMOS threshold voltage and VTN is the NMOS threshold voltage. During power-up, the PMOS transistor 206 turns on the bias PMOS transistor 108 to allow current can flow through the bias PMOS transistor 108 to kick-start the bandgap voltage reference circuit 200. The gate voltage of the bias PMOS transistor 108 gradually rises up to reach a voltage at which it shuts off the PMOS transistor 206, thus disconnecting the start-up circuit 220. Even after the PMOS transistor 206 is shut off, however, a DC current continues to flow through the PMOS transistors 201 and 202 and NMOS transistors 203 and 204. The power consumption caused by the DC current after the circuit start-up is a significant drawback in the bandgap voltage reference circuit 200, which makes it unsuitable for portable devices that require low power consumption.

Furthermore, a bandgap voltage reference circuits 100 and 200 can suffer from slow start-ups. The transistors in the bandgap voltage reference circuits 100 and 200 are typically selected to be very small to minimize DC current consumption. Smaller transistors, however, have smaller trans-conductance, and typically take long time to charge and thus have long start-up times.

There is therefore a need for a bandgap reference voltage circuit that can provide a correct starting point for the bandgap reference voltage circuit, can quickly start from a power-down state, and has no or low power consumption after the start-up.

BRIEF DESCRIPTION OF THE DRAWINGS

The following drawings, which are incorporated in and form a part of the specification, illustrate embodiments of the present invention and, together with the description, serve to explain the principles of the invention.

SUMMARY

Figure 1:
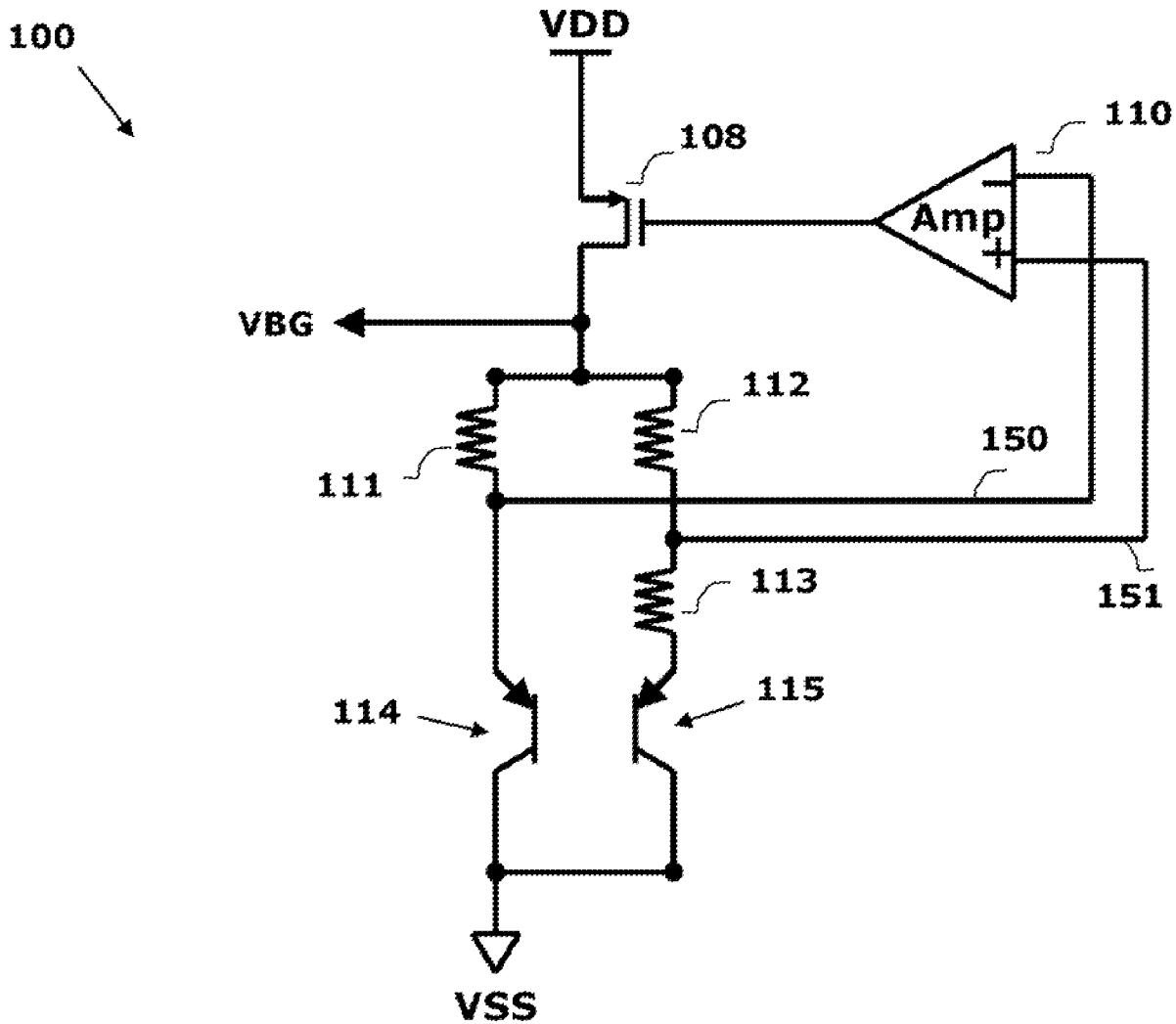
FIG. 1 is a schematic diagram of a conventional bandgap voltage reference circuit without a start-up circuit.
Figure 2:
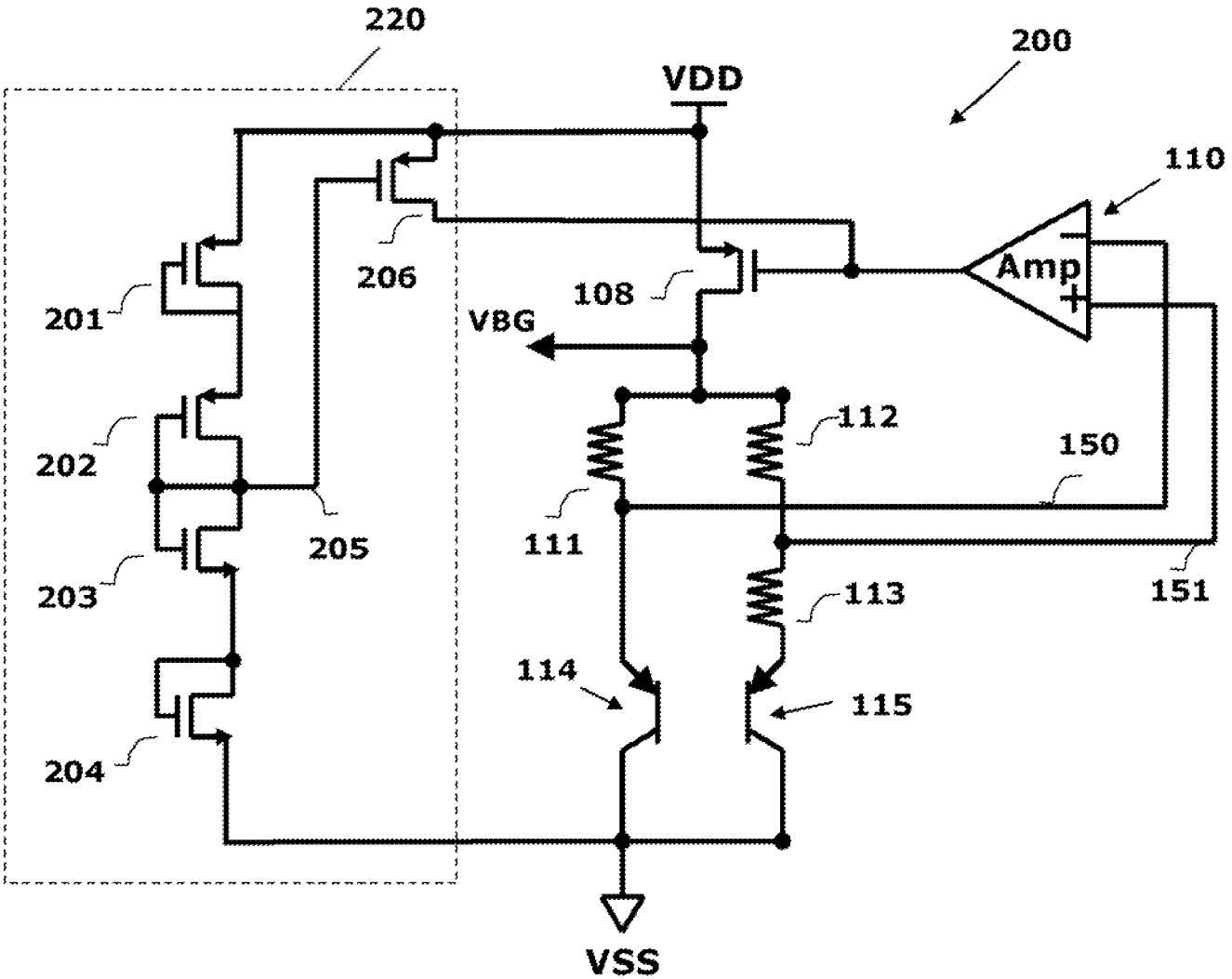
FIG. 2 is a schematic diagram of another conventional bandgap voltage reference circuit including a start-up circuit.

In a general aspect, the present invention relates to a bandgap voltage reference circuit that includes a bandgap voltage generation circuit that can produce a bandgap reference voltage in response to an activation voltage signal, a start-up circuit that can produce the activation voltage signal in response to an one-shot voltage pulse and an one-shot pulse generator circuit that can produce the one-shot voltage pulse. The start-up circuit can be automatically shut off after the one-shot voltage pulse.

In another general aspect, the present invention relates to a bandgap voltage reference circuit that includes a bandgap voltage generation circuit that can produce a bandgap reference voltage in response to an activation voltage signal. The bandgap voltage generation circuit includes a firs diode; a first resistor serially connected with the first diode; a first transistor that can control current flow from a high-voltage supply terminal (VDD) to a low-voltage supply terminal (VSS) through the first diode and the first resistor, wherein the bandgap reference voltage is defined by the voltage across the first diode and the first resistor. The bandgap voltage reference circuit also includes a start-up circuit that can produce the activation voltage signal in response to an one-shot voltage pulse, wherein the activation voltage signal can turn on the first transistor to enable the bandgap voltage generation circuit to produce the bandgap reference voltage across the first diode and the first resistor; and an one-shot pulse generator circuit that can produce the one-shot voltage pulse, wherein the start-up circuit can be automatically shut off after the one-shot voltage pulse.

In yet another general aspect, the present invention relates to bandgap voltage reference circuit that includes a bandgap voltage generation circuit that can produce a bandgap reference voltage in response to an activation voltage signal, an one-shot pulse generator circuit that can produce an one-shot voltage pulse, and a start-up circuit that can produce the activation voltage signal in response to the one-shot voltage pulse, the start-up circuit comprising a second transistor having a gate connected with the output of the one-shot pulse generator circuit. The second transistor can be turned on during the one-shot voltage pulse and can be turned off after the one-shot voltage pulse, thereby automatically shutting off the start-up circuit.

Implementations of the system may include one or more of the following. The bandgap voltage generation circuit can include a first diode, a first resistor serially connected with the first diode; and a first transistor that can control current flow from a high-voltage supply terminal (VDD) to a low-voltage supply terminal (VSS) through the first diode and the first resistor, wherein the bandgap reference voltage is defined by the voltage across the first diode and the first resistor. The bandgap voltage generation circuit can further include a second diode, a second resistor, and third resistor, wherein the second diode, the second resistor, and the third resistor are serially connected, wherein the first transistor can control current flow from VDD to VSS through the second diode, the second resistor, and the third resistor. At least one of the first diode and the second diode can be a transistor-connected diode. The bandgap voltage generation circuit can further include an operation amplifier, wherein an output of the operation amplifier is connected with a gate of the first transistor, a first input of the operation amplifier is connected to anode between the first diode and the first resistor, and a second input of the operation amplifier is connected with a node between the second resistor and the third resistor. The activation voltage signal produced by the start-up circuit can turn on the first transistor to enable the band gap voltage generation circuit to produced the bandgap reference voltage across the first diode and the first resistor. The start-up circuit can include a second transistor having a gate connected with the output of the one-shot pulse generator circuit. The second transistor can be turned on during the one-shot voltage pulse. The second transistor can be turned off after the one-shot voltage pulse, thereby automatically shutting off the start-up circuit.

Embodiments may include one or more of the following advantages. The disclosed bandgap voltage reference circuit can provide a fast and reliable start-up circuit. The disclosed start-up circuit can have low or no power consumption. The disclosed start-up circuit can be implemented with simplicity and small foot print, and can thus minimize cost.

Although the invention has been particularly shown and described with reference to multiple embodiments, it will be understood by persons skilled in the relevant art that various changes in form and details can be made therein without departing from the spirit and scope of the invention.

DETAILED DESCRIPTION

Figure 3A:
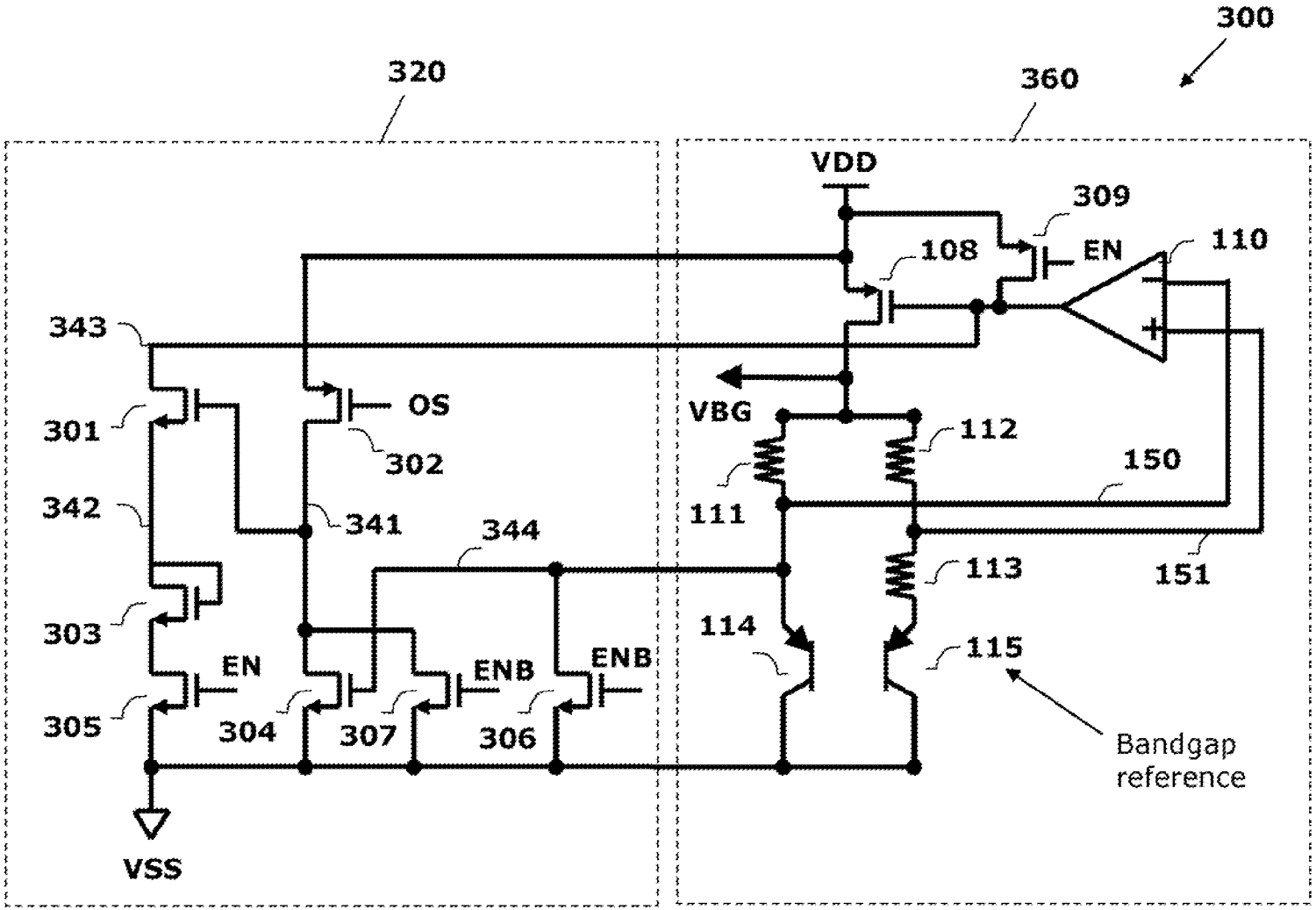
FIG. 3A is a schematic diagram of a bandgap voltage reference circuit including a start-up circuit in accordance with the present specification.
Figure 3B:
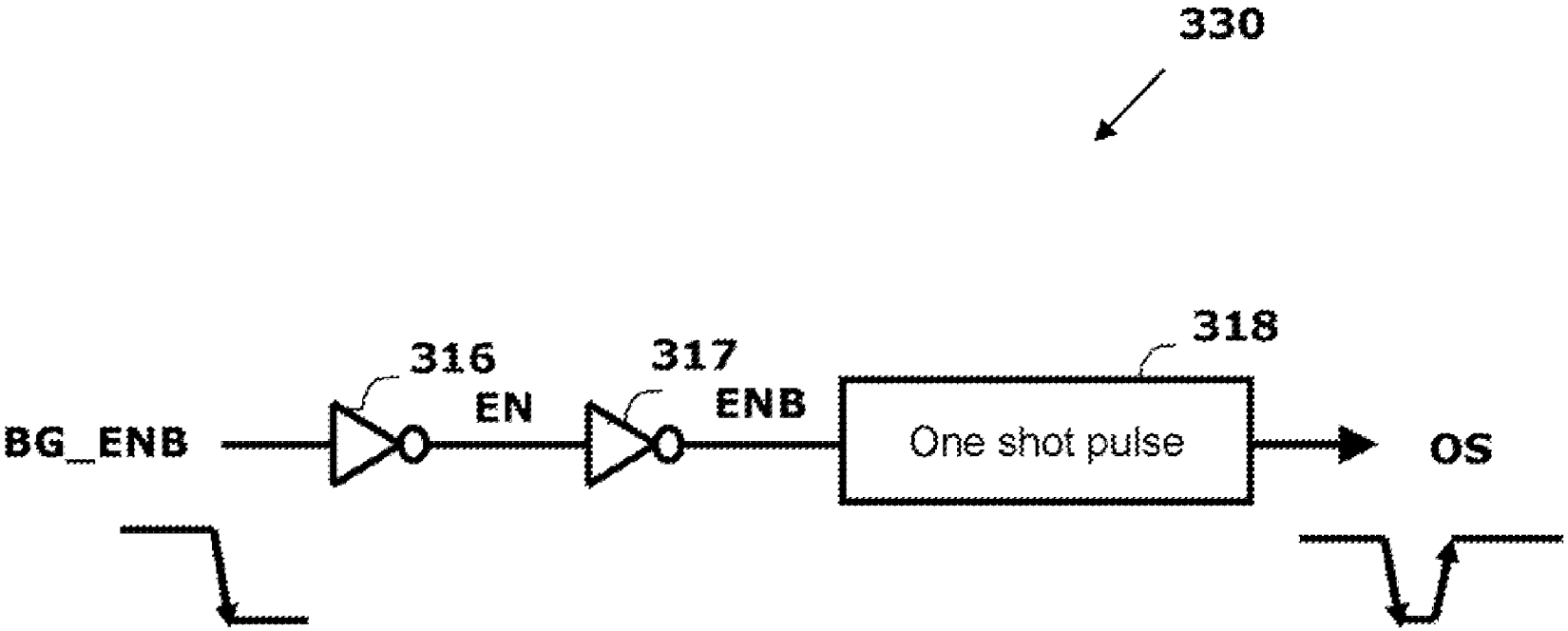
FIG. 3B is a schematic diagram for a one-shot pulse generator circuit compatible with the bandgap voltage reference circuit of FIG. 3A.

Referring to FIGS. 3A and 3B, a bandgap voltage reference circuit 300 includes a start-up circuit 320, one-shot pulse generator circuit 330, and a bandgap voltage generation circuit 360 for producing the bandgap reference voltage. The start-up circuit 320 includes transistors 301-309 for enabling/disabling the bandgap voltage generation circuit 360, and the one-shot pulse generator circuit 330. The bandgap voltage generation circuit 360 includes a PMOS transistor 108, an operational amplifier 110, resistors 111-113, and transistors 114 and 115 that are connected as diodes. The one-shot pulse generator circuit 330 includes inverters 316, 317 and a dedicated one-shot pulse generator 318. The input to the one-shot pulse generator circuit 330, BG_ENB, is a low active enable signal for the bandgap voltage generation circuit 360 and the start-up circuit 320. The one-shot pulse generator circuit 330 can output a signal EN that has an opposite polarity to the input signal BG_ENB, and output a signal ENB that has the same polarity as the input signal BG_ENB. The one-shot pulse generator 318 takes the signal ENB as input and can output a signal OS.

Operations of the bandgap voltage reference circuit 300 are described below for disable mode and normal mode.

Disable-Mode Operation

In a disable mode, the bandgap start-up operation of the bandgap voltage generation circuit 360 is disabled. BG_ENB is set at a high voltage state. This high BG_ENB signal makes the EN signal low and the ENB signal high. The signal OS output by the one-shot pulse generator 318 stays high as well. Transistors 306 and 307 are turned on, which pulls the gates of the transistors 301 and 304 to low voltage and shuts off the transistors 301 and 304. The transistor 305 is also shut-off by the low EN signal. The transistor 309 is tuned by the lower EN signal, which pulls gate node of the transistor 108 to a high voltage, thus shutting off the current paths through the resistors 111-113 and the transistors 114 and 115 in the bandgap voltage generation circuit 360. VBG is thus at VSS (or at zero voltage if VSS is grounded).

Normal-Mode Operation

During normal-mode operation, the start-up circuit 320 and the bandgap voltage generation circuit 360 are both enabled, wherein current can flow from VDD to the start-up circuit 320 and the bandgap voltage generation circuit 360, and VBG is held at the bandgap energy of the semiconductor substrate (e.g. ~1.25V for silicon-based substrate). VBG is initially at a low voltage (i.e. in a disabled mode). No DC current flows through the resistors 111-113 and the transistors 114 and 115. The voltage at the node 344 is low.

When the signal BG_ENB toggles from high to low, the low voltage triggers the one-shot pulse generator circuit 330 to output an one-shot low-voltage pulse at the OS signal. The low-voltage pulse has a pre-determined pulse width defined by the one-shot pulse generator. Such pre-determined low-voltage pulse can turn on the transistor 302, flushing enough current to the node 341 (the transistor 302 can be made large). At the same time, the node 344 is at a low voltage, shutting off the transistor 307. The ENB signal is also low, which shuts off the transistor 307. Therefore, the voltage increases at the node 341, pulling the node 341 to the high voltage and turns on the transistor 301. The transistor 303 is used to shift the voltage level at the source of the transistor 301. When the transistor 301 is turned on, the voltage at the node 343 follows the voltage at the node 342. The node 343 will be around the threshold voltage of the transistor 303. This level shifting function can help define the gate voltage of the transistor 108. Since the gate voltage of the transistor 108 is started to around VTN, the threshold voltage of transistor 303, the transistor 108 is turned on when VSG exceeds VTP. Currents can flow from VDD the resistors 111-113 and the transistors 114 and 115, thus kick-starting the circuit until it becomes stable. Initially, PMOS transistor 108 is operating at linear region since the gate node is biased at VTN, the drain node is initially at VSS and the source node is at VDD. Therefore, a large amount of current can be flushed through the diodes to quickly turn on the bandgap voltage reference circuit until VBG is reached to about 1.25V. The rise of the voltage VBG can bring the gate node of PMOS transistor 108 to a higher voltage level until it is saturated by the operation of the operation amplifier 110. The transistor 302 can be made with a large width-to-length ratio and thus having a high tarns-conductance. The transistor 302 acts as a level shifter to allow the gate voltage of the transistor 108 to start from a higher voltage instead of 0V, which shortens the start-up time and thus improves the performances of the bandgap voltage reference circuit 300.

The gate of transistor 302 receives the OS signal from the one-shot pulse generator 318. The one-shot low-voltage pulse in the OS signal can shut off the transistor 302. The pre-determined pulse width from one-shot pulse generator defines the duration that the current flows from VDD to the node 341. The size of the transistor 302 and the width of the pulse are designed to enable a turn-on transistor 301.

After the bandgap voltage VBG is stabilized to at the bandgap voltage (e.g. around 1.25V for silicon), the voltage at the node 344 becomes the diode voltage of the bipolar transistor 304, around 0.6V. This voltage can then turn on the transistor 307 and finally shuts off the transistor 301. This sequence of actions ensures that no DC current flow through the start-up circuit 320 after the bandgap voltage generation circuit 360 is stabilized, which is an improvement over conventional bandgap voltage reference circuits that have DC current flow and power consumption after the bandgap voltage reference circuit is stabilized.

Figure 4:
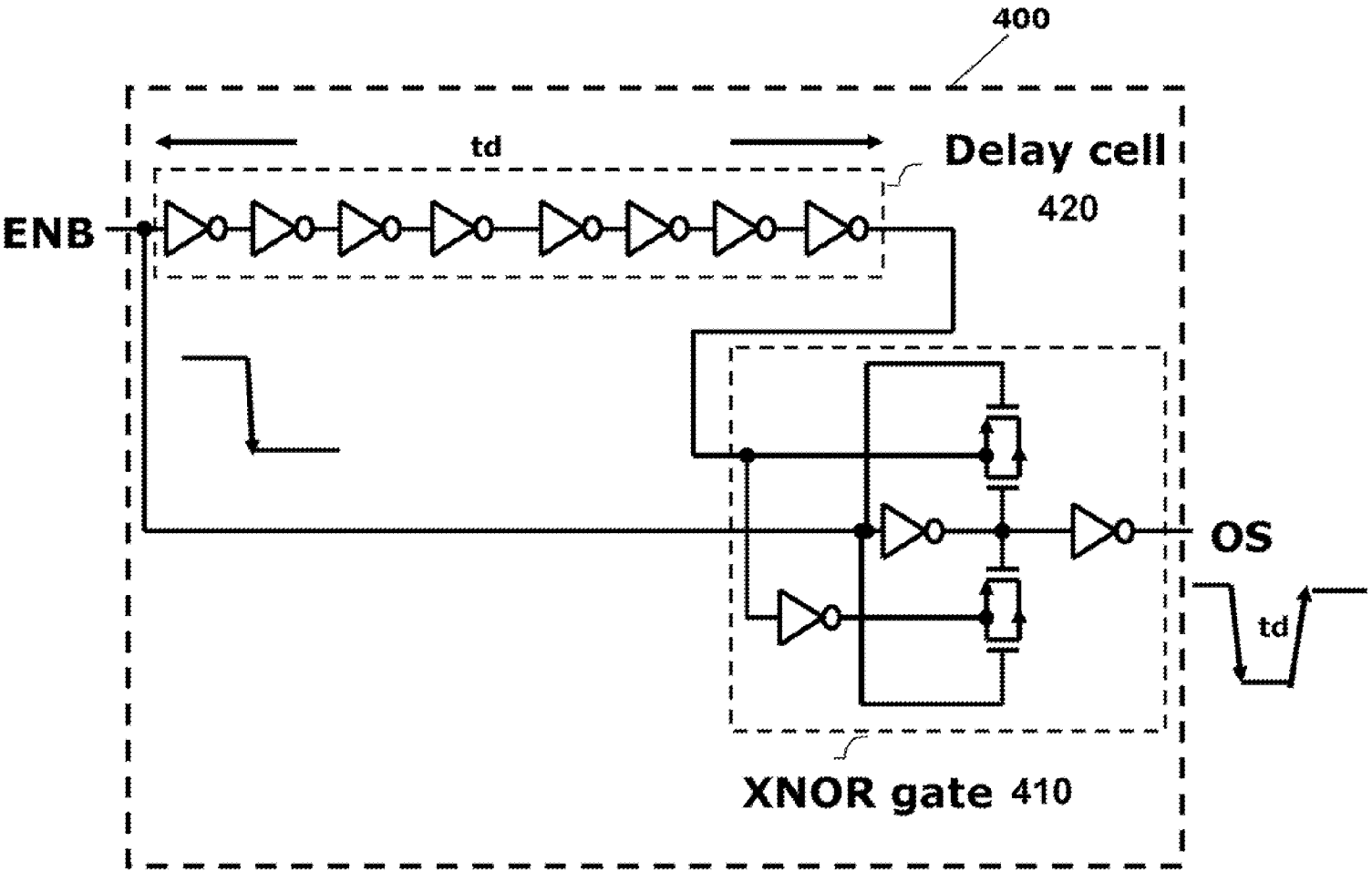
FIG. 4 is a schematic diagram for an exemplified one-shot pulse generator compatible with the bandgap voltage reference circuit of FIG. 3B.

FIG. 4 shows a layout of an exemplified one-shot pulse generator 400 that is compatible with the one-shot pulse generator 118. The one-shot pulse generator 400 includes a XNOR gate 410 and a delay cell 420. The delay cell 420 defines the pre-determined pulse width td. When the ENB signal changes from high voltage to the low voltage, the two inputs to the XNOR gate receives negative pulses that are separated by a delay td defined by the delay cell. The two temporally separated negative voltage drops at the input of the XNOR gate 410 produces the negative voltage pulse having the width td at the OS signal. The negative voltage pulse at the OS signal can turn on the transistor 302 to flush enough current to kick start the bandgap voltage generation circuit 360. This pre-determined pulse width also helps to reduce current consumption during start-up. Once the pulse is finished, no current can further flow through transistor 302 to cause DC current consumption.

Figure 5:
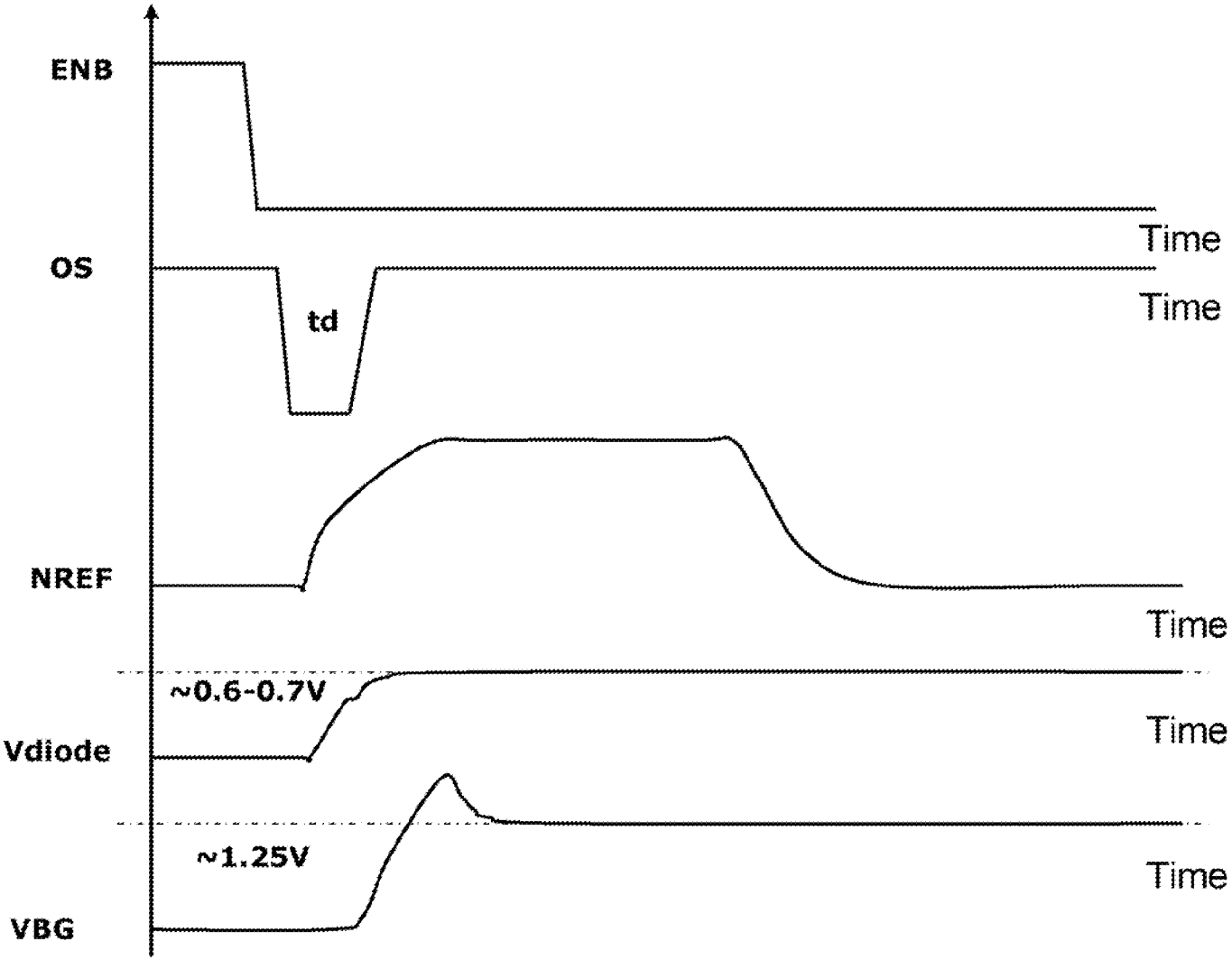
FIG. 5 is a waveform diagram of bandgap voltage reference circuit with a start-up circuit of FIGS. 3A and 3B.

FIG. 5 illustrates waveforms at several key nodes in the bandgap voltage reference circuit 300. As ENB toggles from high voltage to low voltage, the bandgap voltage generation circuit 360 is enabled. A low-voltage pulse is produced at the OS signal by the one-shot pulse generator 118. The one-shot negative-voltage pulse has a pre-determined time width td. The transistor 302 is turned on by the negative pulse OS as described above, which raises the voltage of the note 341, which subsequently turns on the transistor 301. At that moment, the node 150 (Vdiode) is at VSS (or zero voltage is VSS is grounded). Charges therefore do not leak through the transistor 304. The turn-on of transistor 301 pulls the voltage at the node 343 down equal to the voltage at the node 342, which are both at a threshold diode voltage above the VSS. The PMOS transistor 118 is turned on. Current can flow through the resistors 111-113 and the transistors 114 and 115 in the bandgap voltage generation circuit 360. Once the bandgap gradually stats up, the voltage at the node 150 (Vdiode) gradually rises and reaches a diode voltage of the transistor 114 that is connected a diode. The diode voltage of the transistor 114 is determined by set by semiconductor process technologies, which can be at 0.60V-0.70V. When Vdiode gradually rises, it turns on the transistor 304 that is initially shut off. The turn-on of transistor 304 gradually discharges the node 341 (NREF is the voltage at the node 341), which can automatically shut off the transistor 301 after a delay. At that moment, the bandgap voltage VBG is already stabilized without relying on more pulling from the transistor 301. The automatic shut-offs of the transistors 301 and 302 ensure no DC current flowing through the start-up circuit 320 once the bandgap voltage CBG is started, allowing low power consumption by the bandgap voltage reference circuit 300.

The disclosed circuit can include one or more of the following advantages. The disclosed bandgap voltage reference circuit can provide faster and more reliable circuit start-up than conventional systems. The disclosed bandgap voltage reference circuit can have a low power consumption. The disclosed bandgap voltage reference circuit can be implemented with simplicity and small foot print, thus minimizing cost.

It is understood that the one-shot pulse generator in the start-up circuit is compatible with other designs as long as the variation of the start-up circuit can produce a one-shot pulse. Further, the transistor 302 can be replaced by NMOS transistor as long as the NMOS transistor can provide current bias to the transistor 301. The transistor 301 can be replaced by a PMOS as long as it can provide bias voltage to the transistor 108 to kick start the bandgap voltage generation circuit 360. Moreover, the transistor 303 can be replace by a cascaded diode NMOS to level shift up the voltage at the node 342 as long as the VDD is higher than the diode drop of the transistor 303.

What is claimed is:

1. A bandgap voltage reference circuit, comprising:

a bandgap voltage generation circuit configured to produce a bandgap reference voltage in response to an activation voltage signal, the bandgap voltage generation circuit comprising:

a first diode;

a first resistor serially connected with the first diode at a first node, wherein the bandgap reference voltage is defined by the voltage across the first diode and the first resistor; and a first transistor configured to control current flow from a high-voltage supply terminal VDD to a low-voltage supply terminal VSS through the first diode and the first resistor;

an one-shot pulse generator circuit configured to produce an one-shot voltage pulse; and a start-up circuit configured to produce the activation voltage signal in response to the one-shot voltage pulse, the start-up circuit comprising:

a second transistor having a gate connected with the output of the one-shot pulse generator circuit; and a third transistor cascode-connected at a second node and between VDD and VSS, wherein the third transistor has a gate connected to the first node.

2. The bandgap voltage reference circuit of claim 1, wherein the start-up circuit further comprises a fourth transistor having a drain connected to the gate of the first transistor and a gate connected to the second node, wherein the fourth transistor is configured to be shut off after the one-shot voltage pulse.

3. The bandgap voltage reference circuit of claim 2, wherein the start-up circuit comprises a fifth transistor cascade-connected between the fourth transistor and VSS.

4. The bandgap voltage reference circuit of claim 1, wherein the second transistor is configured to be turned on during the one-shot voltage pulse and turned off after the one-shot voltage pulse.

5. The bandgap voltage reference circuit of claim 1, wherein the start-up circuit comprises at least two current paths between VDD and VSS, wherein each of the current paths is configured to be automatically shut off after the one-shot voltage pulse.

6. The bandgap voltage reference circuit of claim 1, wherein the activation voltage signal produced by the start-up circuit is configured to turn on the first transistor produce the bandgap reference voltage across the first diode and the first resistor.

7. The bandgap voltage reference circuit of claim 1, wherein the bandgap voltage generation circuit further comprises:

a second diode;

a second resistor; and a third resistor, wherein the second diode, the second resistor, and the third resistor are serially connected, wherein the second resistor and the third resistor are connected at a third node, wherein the first transistor is configured to control current flow through the second diode, the second resistor, and the third resistor.

8. The bandgap voltage reference circuit of claim 7, wherein the bandgap voltage generation circuit further comprises an operation amplifier having an output connected with the gate of the first transistor, a first input connected to the first node, and a second input connected with the third node.

9. A bandgap voltage reference circuit, comprising:

a bandgap voltage generation circuit configured to produce a bandgap reference voltage in response to an activation voltage signal, the bandgap voltage generation circuit comprising:

a first diode;

a first resistor serially connected with the first diode at a first node; and a first transistor configured to control current flow from a high-voltage supply terminal VDD to a low-voltage supply terminal VSS through the first diode and the first resistor, wherein the bandgap reference voltage is defined by the voltage across the first diode and the first resistor;

an one-shot pulse generator circuit configured to produce an one-shot voltage pulse; and a start-up circuit configured to produce the activation voltage signal in response to the one-shot voltage pulse, the start-up circuit comprising:

a second transistor having a source connected to VDD and a gate connected with the output of the one-shot pulse generator circuit; and a third transistor having a drain connected to the gate of the first transistor and a gate connected to the drain of the second transistor.

10. The bandgap voltage reference circuit of claim 9, wherein the third transistor is configured to be shut off after the one-shot voltage pulse.

11. A bandgap voltage reference circuit, comprising:

a bandgap voltage generation circuit configured to produce a bandgap reference voltage in response to an activation voltage signal, the bandgap voltage generation circuit comprising:

a first diode;

a first resistor serially connected with the first diode at a first node; and a first transistor configured to control current flow from a high-voltage supply terminal VDD to a low-voltage supply terminal VSS through the first diode and the first resistor, wherein the bandgap reference voltage is defined by the voltage across the first diode and the first resistor;

an one-shot pulse generator circuit configured to produce an one-shot voltage pulse; and a start-up circuit configured to produce the activation voltage signal in response to the one-shot voltage pulse, the start-up circuit comprising:

a second transistor having a gate connected with the output of the one-shot pulse generator circuit;

a third transistor cascode-connected at a second node and between VDD and VSS, wherein the third transistor has a gate connected to the first node;

a fourth transistor having a drain connected to the gate of the first transistor and a gate connected to the second node, wherein the fourth transistor is configured to be shut off after the one-shot voltage pulse; and a fifth transistor cascade-connected between the fourth transistor and VSS.

* * * * *